United States Patent [19]

Pelster

[11] 4,312,448

[45] Jan. 26, 1982

[54] STATION WIRE BOX WITH INSERT

[75] Inventor: James J. Pelster, Sidney, Nebr.

[73] Assignee: Eltra Corporation, Toledo, Ohio

[21] Appl. No.: 114,853

[22] Filed: Jan. 24, 1980

[51] Int. Cl.[3] ..... B65D 85/671

[52] U.S. Cl. ..... 206/409; 242/146

[58] Field of Search ..... 206/409, 407, 389, 329; 242/137.1, 146, 171; 217/110

[56] References Cited

U.S. PATENT DOCUMENTS

| | | | |
|---|---|---|---|
| 1,040,740 | 10/1912 | Niswonger | 242/146 |
| 2,579,131 | 12/1951 | Tinsley | 206/409 |
| 2,634,922 | 4/1953 | Taylor . | |
| 2,796,170 | 6/1957 | Davis | 206/409 |
| 3,390,844 | 7/1968 | Dillow | 206/409 |
| 3,721,382 | 3/1973 | Cavanagh | 206/409 |
| 3,982,712 | 9/1976 | Bassett . | |
| 4,160,533 | 7/1979 | Kotzur . | |
| 4,202,463 | 5/1980 | Mogler | 217/110 |

*Primary Examiner*—Herbert F. Ross
*Attorney, Agent, or Firm*—James P. DeClercq

[57] ABSTRACT

A container of the type known as a station wire box, from its application to dispensing wire for installation of telephone equipment on a user's premises, or station, is provided with an insert centrally located in one face of the box, for smooth manual dispensing of the wire, and perforations on the reverse side of the box. The perforations define a first area removable to form a combined access opening and carrying handle opening. The access opening allows access to ties binding a coil of wire, to remove the ties, and lead an end of the coil of wire through the insert. The reverse side also includes perforations defining areas adjoining the access opening which can be removed to form a circular opening in the box, equivalent in size to the circular opening in a conventional station wire box, so that the box can be used as a conventional station wire box.

4 Claims, 6 Drawing Figures

STATION WIRE BOX WITH INSERT

This application relates generally to a container for dispensing a flexible linear material. In particular, the present invention relates to a box for dispensing wire of a type used by telephone installers and called station wire.

BACKGROUND OF THE INVENTION

Installers of telephone equipment customarily use a particular kind of wire for connecting between telephone equipment located on the user's premises, or station. The wire is called station wire, and customarily comprises four insulated conductors, covered by a plastic jacket. It is customarily dispensed from a generally square, flat box, containing a coil of about 500 feet (150 meters). One face of this box is provided with a large circular perforation. When the area bounded by the perforation is removed, the resulting large circular hole is used by the user to gain access to the interior of the box, unfasten wire ties retaining the coil, and lead the inner end of the coiled wire through the hole. Since the wire will not feed smoothly except if withdrawn along the axis of the coil of wire and the circular hole, the box is then propped against any available object, usually to an angle of approximately 45°. Of course, the tension of the wire being withdrawn often causes the box to fall, necessitating repositioning the box for further use. In addition, particularly when the coil is almost depleted, a loop of wire being withdrawn half-hitches a loop of the coil, pulling undesired loops of wire through the hole.

The instant invention overcomes such deficiencies of the prior art.

SUMMARY OF THE INVENTION

It is an object of the present invention to provide a container for a coil of linear flexible material, such as a station wire box, with a plastic insert to aid in smooth withdrawal of the wire from the box.

It is a further object of the invention to provide such a station wire box having a plastic insert for aiding in smooth withdrawal of the wire, as well as having provisions for withdrawing the wire from the box in the conventional manner, should the user so desire.

It is a further object of the invention to provide a station wire box and plastic insert which are simple and inexpensive to make and convenient to use.

DESCRIPTION OF THE PREFERRED EMBODIMENT

Figure 1:
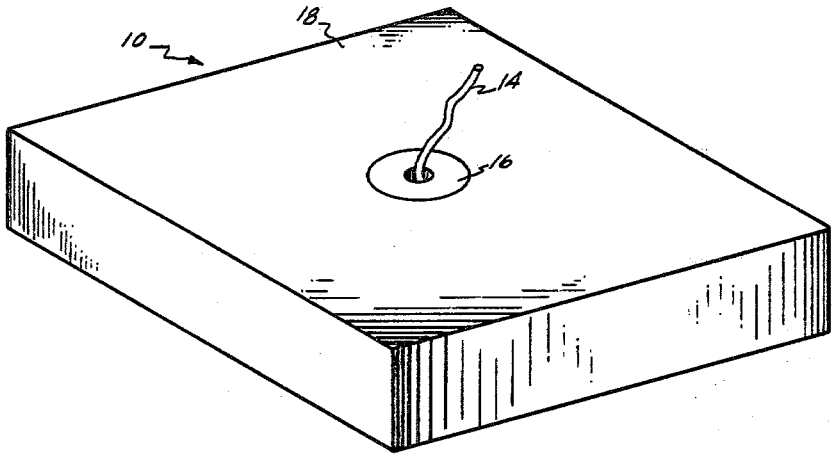
FIG. 1 is a top perspective view of a station wire box according to the preferred embodiment of the invention.
Figure 2:
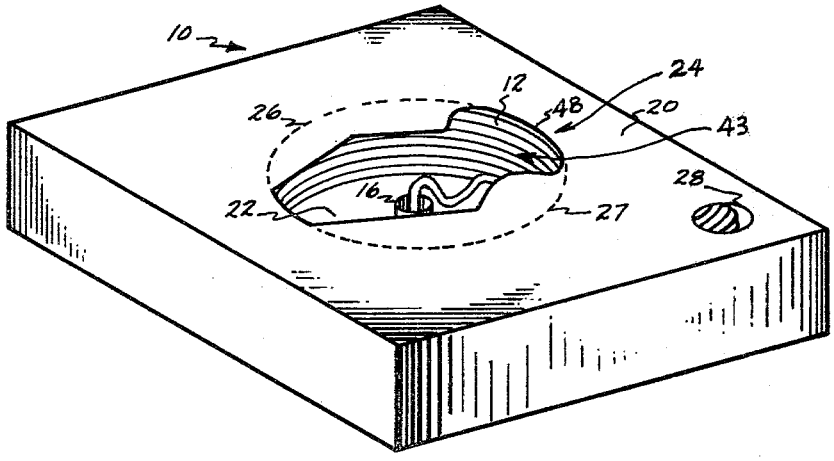
FIG. 2 is a bottom perspective view of a station wire box according to the preferred embodiment of the invention.

FIGS. 1 and 2 show the preferred embodiment of the invention, in use. A box 10 contains a coil of wire 12. An end 14 of wire 12 is passed through an insert 16 in top surface 18 of box 10, to be dispensed. In FIG. 2, a first portion of the bottom surface 20 of box 10 is shown removed, forming a combined access opening 22 and carrying handle portion 24. Perforations 26 and 27 define an area that may be removed in order to use a station wire box in accordance with the invention in conventional manner, if desired. Another portion of the box has been removed, forming an aperture 28, allowing viewing of the outer portion of wire coil 12 to deterine visually the amount of wire remaining in box 10.

Figure 3:
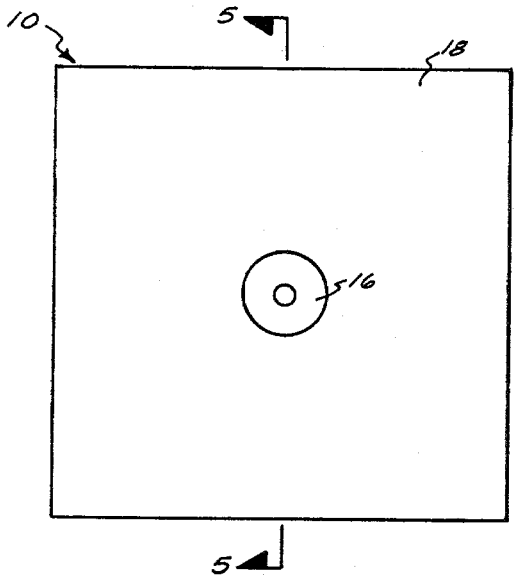
FIG. 3 is a top-elevational view of a station wire box according to the preferred embodiment of the invention.

FIG. 3 is a top-elevation or plan view of the top surface 18 of box 1, with insert 16 approximately centered on surface 18.

Figure 4:
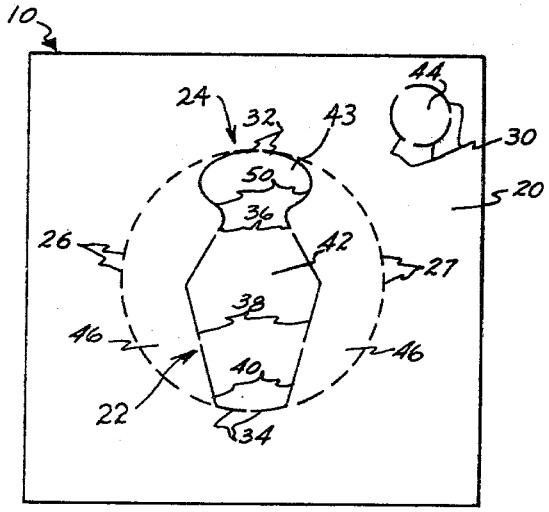
FIG. 4 is a bottom elevational view of a station wire box according to the preferred embodiment of the invention.

FIG. 4 is a bottom-elevational view of a station wire box according to the invention, illustrating the various areas that may be removed for various purposes. Bottom surface 20 of a station wire box 10 according to the preferred embodiment of the invention includes perforations 26, 27, 30, 32, 34, 36, 38 and 40. As can be seen from FIG. 4, perforations 30, 32, 34, 36, 38 and 40 are substantially longer than perforations 26 and 27. Perforations 30, 32, 34, 36, 38 and 40 define sections which have been called "knock-outs" from their method of removal, while perforations 26 and 27 define removable portions which are somewhat harder to remove due to more material to be torn per unit length of perforations than "knock-outs". Perforations 30 define circular portion 44, removable to form viewing aperture 28 for allowing visibility of the outermost turns of wire coil 12, for determining when coil 12 is nearly depleted. Perforations 32, 34, 36, 38 and 40 define portion 42, used to provide an access opening 22 for manual access to wire coil 12, to remove ties, not shown, encircling coil 12, and for passing end 14 of wire from coil 12 through insert 16 for dispensing the wire, and to provide a handle portion 24. Obviously, a separate removable area could be provided for a handle, if desired. However, upon removal of portion 42, it will be noted that perforations 32 define an arcuate gripping surface 48, while portions 50 of perforations 36 define a clearance portion 43 for the width of the user's hand for integral handle portion 24. The remainder of perforations 34, 36, 38 and 40 define access opening 22, which, in the preferred embodiment of the invention, is in the form of a slot-like opening which is widened towards the middle of surface 20. This configuration allows adequate room for a user's hand to be inserted into box 10 for preparing wire coil 12 for dispensing, and allows access to all portions of wire coil 12, while removing as little material from surface 20 as possible, resulting in a stronger construction.

Should a user wish to use this novel station wire box 10 as a conventional station wire box, after portion 42 has been removed, arcuate portions 46 may be removed by tearing along perforations 26 and 27, to form a conventional larger circular opening in surface 20. This also allows the use of box 10 should surface 18 be damaged by some accident or rough handling to the point that insert 16 is no longer retained in surface 18, since removal of insert 16 and portions 46 effectively converts box 10 to a conventional station wire box.

Figure 5:
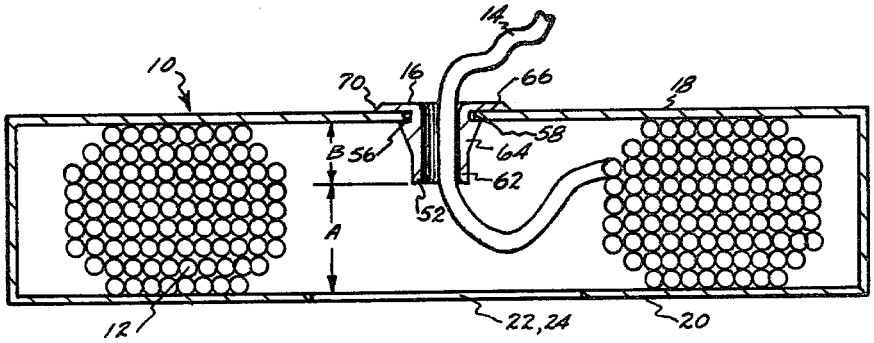
FIG. 5 is a sectional view of a station wire box according to the preferred embodiment of the invention taken along line 5—5 in FIG. 3.

FIG. 5 shows a sectional view through the center of box 10 with a wire coil 12, a wire end 14 being dispensed through an insert 16. In the preferred embodiment of the invention, dimensions A, from bottom surface 20 to tip 52 of insert 16, and dimension B from tip 52 of insert 16 to top surface 18 are approximately identical, so that tip 52 of insert 16 to top surface 18 are approximately half-way into box 10. In an actual embodiment, dimension B is approximately 1 inch (2.5 cm) and dimension A is approximately 1.5 inch (3.8 cm). This places tip 52 substantially in line with a mid-point of wire coil 2, considering wire diameter, stiffness and bend radius. It should be noted that wire 12 is a conventional, mandrel-wound coil, so that wire may be payed out from its interior surface. If desired, wire coil 12 could even be a hand-wound hank of wire, as long as it is wound smoothly enough, without crossovers, as to be payed out without snarling. Also, as can be seen from FIG. 5, insert 16 is disposed in an aperture 56 in surface 18. Insert 16 is pushed into surface 18, and is retained by the periphery of aperture 56 in groove 58 of insert 16.

Figure 6:
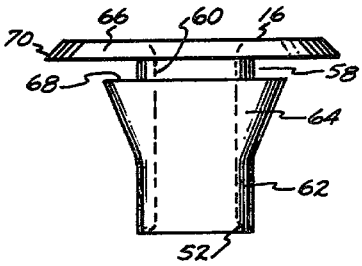
FIG. 6 is a detail view of an insert according to the preferred embodiment of the invention for use with the station wire box according to the preferred embodiment of the invention.

FIG. 6 is a detail view of insert 16. As can be seen, the preferred embodiment of insert 16 has a tubular bore 60, a first wall portion 62 which is concentric with bore 60, and a second wall portion 64, which is of increasing diameter towards flange portion 66 forming a cone-shaped portion to aid in insertion of insert 16 in aperture 56. An end surface 68 of wall portion 64, and flange portion 66, define the groove 58 which cooperates with aperture 56 to retain insert 16 in surface 20 of box 10. In the preferred embodiment of the invention, flange portion 66 also includes a tapered portion 70, so that flange portion 66 will effectively blend into surface 20, to reduce the opportunity for accidently dislodging insert 16.

It will be apparent that numerous modifications and changes can be made to the preferred embodiment of the invention, without departing from the scope of the invention, including but not limited to various configurations for an insert, and various patterns of perforations defining and access opening, and viewing openings and handles, if desired.

I claim:

1. A package of linear flexible material comprising:

a coil of linear flexible material;

a container having a first face and a second face, said first and second faces being disposed parallel to said coil and on opposite sides of said coil;

said first face having an aperture therein and a tubular insert disposed perpendicular to said first face in said aperture, said insert extending inwardly from said first face towards said second face;

said insert having a length of approximately one half of the distance between said first and second faces;

said insert including a flange portion disposed on an exterior surface of said first face, and a tapered portion disposed adjacent to an interior surface of said first face, said tapered portion having a larger end thereof disposed adjacent said first face;

said flange portion and said tapered portion defining a groove interposed between said flange portion and said tapered portion for cooperating with said aperture in said first face to retain said insert in said first face;

said second face having first perforations therethrough defining a first portion, to be removed and to allow manual access to said coil to pass an end thereof through said insert;

said second face further having second and third perforations therethrough, encircling said first perforations and having; second and third portions adapted to be removed, said second and third portions being contiguous with said first portion;

said first, second and third portions together defining a removable circular portion;

said package being adapted to alternatively dispense said end of said linear flexible material through said insert and through the circular aperture formed by removing said removable circular portion when the first face and insert are damaged.

2. A package of linear flexible material according to claim 1, wherein:

said first perforations defining said first portion further define a handle portion;

said handle portion including an arcuate gripping surface defining a portion of said circular aperture and a hand clearance portion defined by said second portion and said third portion, said hand clearance portion and said arcuate gripping surface being disposed between said second portion and said third portion.

3. A container for a coil of linear flexible material, comprising:

a first face, a second face disposed parallel to said first face;

said first face having an aperture therethrough;

said aperture having a tubular insert therein extending inwardly from said first face toward said second face;

said insert having a flange portion disposed upon an exterior surface of said first face and a tapered portion disposed inwardly from said first face, said tapered portion having a larger end thereof portion defining a circumferential groove therebetween, said groove being fitted within said aperture of said first face to retain said insert in said face;

said insert extending approximately one half of the distance between said first and second faces;

said second face having first perforations therethrough, defining a first portion to be removed to allow manual access to said coil to pass an end thereof through said insert;

said second face further having second and third perforations therethrough encircling said first perforation, said second and third perforations defining second and third portions adapted to be removed, said second and third portions being contiguous with said first portion;

said first, second and third removable portions together forming a removable circular portion;

said container being adapted to alternatively dispense said end of said coil through said insert and through the circular aperture formed by removing said removable circular portion when the first face and insert are damaged.

4. A container according to claim 3, wherein:

said first perforations defining said first portion further define a handle portion;

said handle portion including an arcuate gripping surface defining a portion of said circular aperture and a hand clearance portion defined by said second portion and said third portion, said hand clearance portion and said arcuate gripping surface being disposed between said second portion and said third portion.

* * * * *

UNITED STATES PATENT AND TRADEMARK OFFICE

CERTIFICATE OF CORRECTION

PATENT NO. : 4,312,448

DATED : January 26, 1982

INVENTOR(S) : James J. Pelster

It is certified that error appears in the above-identified patent and that said Letters Patent are hereby corrected as shown below:

Claim 3, line 12, after "thereof" insert --disposed adjacent said first face, said flange and said tapered--.

Signed and Sealed this

*First* Day of *June 1982*

[SEAL]

*Attest:*

GERALD J. MOSSINGHOFF

*Attesting Officer*

*Commissioner of Patents and Trademarks*